United States Patent [19]

Van Brocklin

[11] Patent Number: 4,991,747

[45] Date of Patent: Feb. 12, 1991

[54] SEALING PUMP

[75] Inventor: Owen F. Van Brocklin, Bristol, Conn.

[73] Assignee: Risdon Corporation, Naugatuck, Conn.

[21] Appl. No.: 256,327

[22] Filed: Oct. 11, 1988

[51] Int. Cl.[5] ..... B65D 88/54

[52] U.S. Cl. ..... 222/321; 222/341; 222/385; 222/477; 222/571; 239/333; 417/446

[58] Field of Search ..... 222/321, 341, 383, 385, 222/477, 571, 108, 109; 417/444, 446, 552, 554; 239/333

[56] References Cited

U.S. PATENT DOCUMENTS

| | | | |
|---|---|---|---|
| 1,196,584 | 8/1916 | Randolph | 417/444 |
| 3,128,018 | 4/1964 | Corsette | 222/321 |
| 3,185,354 | 5/1965 | Lipman | 222/341 X |
| 3,187,960 | 6/1965 | Gorman | 222/321 |
| 3,362,344 | 1/1968 | Duda | 222/321 X |
| 4,120,619 | 10/1978 | Blackband | 222/321 X |
| 4,147,476 | 4/1979 | Warren | 222/321 X |
| 4,286,736 | 9/1981 | Corsette | 222/321 |
| 4,340,158 | 7/1982 | Ford et al. | 222/321 |
| 4,344,744 | 8/1982 | Schuster | 417/554 X |
| 4,524,888 | 6/1985 | Tada | 222/321 X |

*Primary Examiner*—Michael S. Huppert
*Assistant Examiner*—Gregory L. Huson
*Attorney, Agent, or Firm*—St. Onge Steward Johnston & Reens

[57] ABSTRACT

A reciprocating pump for dispensing liquids from a container comprises a hollow body in which is slidably fitted a hollow piston. A piston seat is located in the body and provides a segment sized for sealing fit inside the hollow piston, thereby minimizing possible leakage through the pump when it is transported with a liquid filled container. Upper and lower valves are provided in the piston and body respectively. The piston seat is adapted to interact with the upper valve member to hold it open during a portion of an upward stroke of the piston thereby drawing any undispensed liquid back into the pump.

27 Claims, 4 Drawing Sheets

SEALING PUMP

BACKGROUND OF THE INVENTION

1. Field of the Invention

The present invention relates to manually operated reciprocating pumps for dispensing liquids from a container.

2. Background of the Invention

A conventional throttling pump for dispensing liquids from a container includes a hollow body having opening in each end, into the upper end of which is fitted a hollow piston which is slidable reciprocally in the body with sealing fit, which piston is connected at its upper end to an actuator. The piston and body define an interior chamber having an opening at each end. The upper opening of the piston connects with a nozzle of the actuator from which the liquid is dispensed. An outlet valve is located in the upper opening and may be a ball-type valve. An inlet ball-type valve is located in the lower opening in the lower end portion of the body. The ball-type valves comprise floating balls which seat on circular valve seats formed in the piston and body. The operation of such ball-type valves is dependent on liquid pressure causing the ball to move away from the valve seat. Typically, during a dispensing stroke of the piston, force is applied to the actuator, which causes the piston to slide downwardly into the body, causing the piston chamber to decrease in size and the pressure inside the chamber to increase. The liquid pressure inside the chamber causes the upper valve to open, while the lower valve is held closed by the same pressure, so that liquid flows out of the chamber and is dispensed. A spring is provided to return the piston to an up position when the actuator is released. During an upward stroke, a vacuum is formed in the chamber causing the upper valve to close and the lower valve to open so that liquid is drawn through the opening in the lower end of the body into the chamber.

It has been found that the pump described above is prone to leakage around the valves. For example, an increase in temperature can cause the liquid to expand and cause a sufficient pressure increase in the container such that both the upper and lower valves open, allowing the liquid to flow out of container and through the actuator nozzle. Similarly, if the pump is upended there will be leakage around the valves. Accordingly, it is desireable to provide a positive seal for the pump so that a container and pump may be conveniently transported as a unit without having to provide a separate cap for the container which must be replaced by the pump when the unit is to be used.

In addition, it has been found that it is desireable to provide a way for liquid which is in the dispensing nozzle of the actuator to be drawn back into the pump so that drops of liquid are not left on the tip of the nozzle.

An additional problem arises when a conventional pump is used to dispense viscous liquids such as liquid soap or lotions. The conventional pump may be very difficult to prime with such viscous liquids, since the leakage of air around the valves may reduce the vacuum created in the piston chamber by an upward stroke so that there is an insufficient pressure differential between the piston chamber and the container, to overcome gravity and the flow resistance of the viscous liquid.

A final problem associated with the conventional pump design is its reduced effectiveness when it is not vertically oriented during use. Since during the initial portion of the piston stroke, before a pressure differential is developed, the balls of the valves are held in place by gravity, the balls may not seal the valves if the pump is moved from the vertical position. In addition, when a viscous liquid is being pumped, the balls will tend to be suspended in the liquid and the sealing of the valves will be slowed, reducing the pump's effectiveness.

Several improvements over the conventional pump design have been proposed. U.S. Pat. No. 4,606,479 to Van Brocklin discloses a pump in which the ball-type valves of the conventional pump are replaced with a valve member which is movable inside the piston and operates as an upper valve by seating its upper end in a valve seat in the upper end of the piston, and which operates as a lower valve by frictionally engaging a cylindrical sleeve which is movable to seat around a ring formed in the lower end of the body. The pump does not however have the capability to draw material back from the actuator nozzle tip.

Other patents of interest include U.S. Pat. No. 3,237,571 to Corsette; U.S. Pat. No. 3,627,206 to Boris; U.S. Pat. No. 4230,242 to Meshberg; and U.S. Pat. No. 4212,332 to Kutik et al.

SUMMARY OF THE INVENTION

It is an object of the invention to provide a pump for dispensing liquids from a container which may be positively sealed for transporting the container. It is a further object of the invention to provide a pump which is easily primed when used with viscous liquids. It is a further object of the invention to provide a pump which draws any undispensed liquid from the dispensing nozzle back into the piston chamber. It is a further object in one embodiment of the invention to provide a pump which is operable in any orientation, without requiring gravitational forces for effectiveness.

These objects, and other objects which will become apparent from the description that follows, are achieved by a pump generally comprising a hollow body for receiving liquid from a container, which has upper and lower ends having openings therein; a hollow piston slidable reciprocally with sealing fit in the body, the piston having upper and lower ends having openings therein; a piston seat sized to be received inside the piston, the piston seat having a larger diameter segment at its lower end sized for sealing fit inside the piston when the piston is at the bottom of a downward stroke, the piston seat having a smaller diameter segment at its upper end sized to provide a space between the smaller diameter segment and the inner walls of the piston; a chamber defined by the piston, body, and piston seat; means for biasing the piston against a downward stroke and for biasing the piston with an upward stroke; an upper valve positioned in the upper end of the piston, the upper valve being moveable to open the opening in the upper end of the piston during a downward stroke of the piston to dispense liquids from the chamber and to close the opening during an upward stroke of the piston; and a lower valve positioned in the lower end of the body, the lower valve being moveable to open the opening in the lower end of the body during an upward stroke of the piston to permit liquid to enter the chamber and to close the opening during a downward stroke of the piston.

An actuator may be seated on the upper end of the piston and has a nozzle, connected to the upper opening in the piston, from which liquid is dispensed.

A container closure may be joined to upper end of the body and may have means for holding the piston in place at the bottom of a downward stroke, which preferably comprises a collar extending upwardly from the container closure having threads formed on its inner surface which mate with threads formed on the outer surface of the actuator.

The biasing means preferably comprises a coil spring, the upper end of which is fitted into an annular chamber formed on the lower end of the piston, and the lower end of which holds down the lower end of the piston seat.

In one embodiment of the invention, the upper and lower valves are biased to be closed and are moveable under liquid pressure against their biases whereby they may be opened.

In a second embodiment of the invention, the piston seat further comprises a lower valve member formed at its lower end and the smaller diameter segment has a bore formed therein, and the piston seat is slidable reciprocally inside the piston; the upper valve comprising an upper valve seat formed in the upper end of the piston and a valve member having a stem extending downwardly and slidably fitting inside the bore of the smaller diameter segment of the piston seat, the stem being sized to frictionally engage the bore, the valve being openable to dispense liquid from the chamber by a downward stroke of the piston whereby the upper valve seat moves downwardly while the upper valve member is held stationary by the frictional engagement of the stem in the bore; and the lower valve comprising a valve seat formed in the lower end of the body and the lower valve member formed on the piston seat, the valve being closeable by an downward stroke of the piston whereby the contact between the lower end of the actuator with the upper valve member causes the piston seat to move downwardly so that the lower valve member seats against the lower valve seat.

DESCRIPTION OF THE PREFERRED EMBODIMENT

Figure 1:
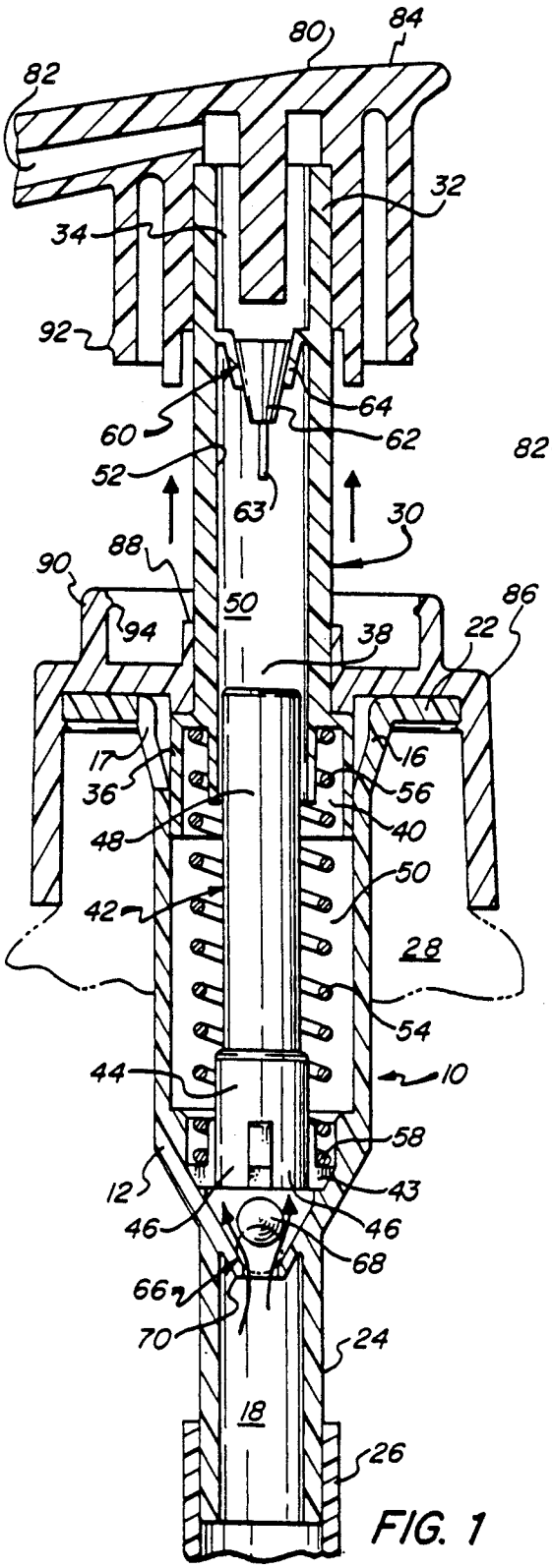
FIG. 1 is a cross-sectional view of a first embodiment of a pump of the present invention with its piston in an up position at the end of an upward stroke.
Figure 2A:
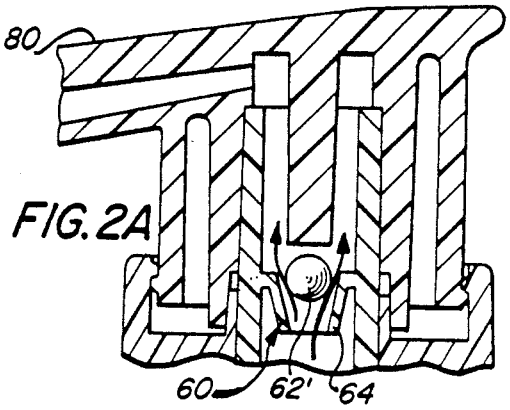
FIG. 2*a* is a cross-sectional view of the upper valve and seat of the pump of FIGS. 1 and 2 and wherein the valve is a ball valve.
Figure 2:
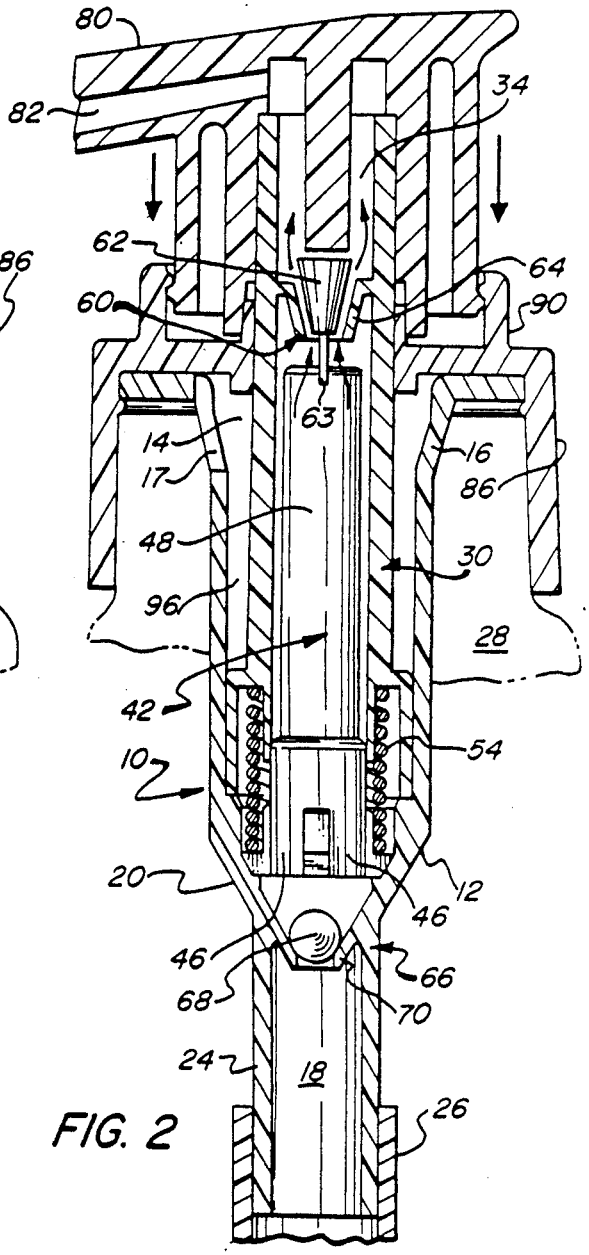
FIG. 2 is a cross-sectional view of the pump of FIG. 1, with the piston held locked in a down position at the end of a downward stroke.

With reference to FIGS. 1–2, a first embodiment of a sealing pump 10 in accordance with the invention is shown. Pump 10 comprises a hollow body 12 having an upper opening 14 in its upper end 16 and a lower opening 18 in its lower end 20. Preferably the body 12 is cylindrical and has a flange 22 extending radially outwardly from its upper end 16. Preferably vent 17 is provided in the upper end 16 of the body 12. Preferably the lower end 20 of the body 12 is tapered in the vicinity of the lower opening 18. A hollow tube 24 extends from the lower end of the body 12, and a diptube 26 which extends down into the container 28 may be fitted onto tube 24. During operation of the pump 10, liquid is drawn up from container 28 through the diptube 26 into tube 24 and thence into pump 10.

A hollow piston 30 which is slidable reciprocally with sealing fit in body 12 is fitted into the upper end 16 of body 12. Piston 30 has an upper end 32 with an opening 34 therein, and a lower end 36 with an opening 38 therein. Preferably piston 30 is cylindrical. Preferably the lower end 36 has a larger diameter than the upper end 32. An annular chamber 40 may be provided in the lower end 36 of the piston 30.

A piston seat 42 sized to be received inside piston 30 is fitted inside the piston 30 and the body 12. As shown in FIGS. 1 and 2, piston seat 42 has a larger diameter segment 44 at its lower end sized for sealing fit inside piston 30 when piston 30 is at the end of a downward stroke. The larger diameter segment 44 is retained at its lower end adjacent the opening 18 in the lower end 20 of body 12. Preferably, the larger diameter segment 44 has a flange 43. A flow passage 46 is provided in the larger diameter segment 44 so that liquid can flow from the opening 18 past the piston seat 42 and up into the upper portions of the body 12. Piston seat 42 has a smaller diameter segment 48 at its upper end sized to provide a space between the exterior of the smaller diameter segment 48 and the inner walls 52 of the piston 30. A chamber 50 is defined by the inner walls of the piston 30, the inner walls of the body 12, and the outer walls of the piston seat 42.

Means for biasing piston 30 against a downward stroke and for biasing it with an upward stroke is provided, and preferably comprises a coil spring 54. The upper end 56 of the coil spring 54 fits into annular chamber 40 in the lower end of piston 30. The lower end 58 of coil spring 54 may be located to press against and retain the flange 43 on the lower end of the piston seat 42.

An upper valve 60 is positioned in the upper end 32 of piston 30. Upper valve 60 is moveable to open the opening 34 in the upper end 32 of piston 30 during a downward stoke of piston 30 to dispense liquids from the chamber 50. Upper valve 60 is biased to be closed and is moveable under liquid pressure against its bias to open opening 34. Upper valve 60 comprises an upper valve member 62, such as a ball 62' as shown in FIG. 2A, which can be sealingly fitted into upper valve seat 64 formed on the inner walls of the piston 30. Preferably, the upper end of the piston seat 42 and the upper valve member 62 are sized and adapted so that the upper valve 60 is held open during an initial portion of an upward stroke of the piston 30. For example, the upper end of the piston seat 42 may have a stem extending upwardly and sized to fit into valve seat 64 so that the upper valve 60 is held open by the stem during the terminal portion of a downward stroke of the piston 30 and during the initial portion of an upward stroke of the piston 30. Alternatively, the valve member 62 may have a stem 63 extending downwardly through the valve seat 64 as shown in FIG. 2, so that the upper valve 60 is held open by the stem 63 during the terminal portion of a downward stroke of the piston 30 and during the initial portion of an upward stroke of the piston 30.

The particular design of the valve member 62 may be selected from a variety of shapes, and may for example, be conical or bullet shaped.

A lower valve 66 is positioned in the lower end of body 12. Lower valve 66 is moveable to open the opening 18 in lower end 20 of body 12 during an upward stroke of piston 30, to permit liquid to enter chamber 50. Lower valve 66 is biased to be closed and is moveable under liquid pressure against its bias to open the opening 18. Lower valve 66 comprises an upper valve member, such as a ball 68 which can be sealingly fitted into lower valve seat 70 located on the inner walls of the body 12. Other valve member designs may be used in place of a ball-type valve. For example, a conical or bullet shaped valve member may be employed.

An actuator 80 may be seated on the upper end of piston 30. Actuator 80 has a nozzle 82 for dispensing liquid, and an upper surface 84 for finger actuation of the pump 10.

Pump 10 is secured to container 28 by a sealing container closure 86. The flange 22 of body 12 fits into container closure 86 with a sealing fit. Container closure 86 has a central aperture 88 through which extends the upper end 32 of piston 30. Piston 30 is retained in the body 12 by providing its lower end 36 with a larger diameter than its upper end 32 so that the lower end 36 cannot pass through the aperture 88 of the closure 86. Container closure 86 fits over the neck of the container 28 and may be held in place by screw threads formed on both, or by a snap fit combination.

Means for holding piston 30 in place at the bottom of a downward stroke is preferably provided. Preferably, the container closure 86 further comprises a collar 90 extending upwardly from closure 86, and the holding means comprises mating threads 92 and 94 formed on the outer surface of actuator 80 and on the inner surface of collar 90.

Preferably the various components of the pump 10 are formed of polymeric materials, preferably polypropylene or polyethylene. The coil spring is preferably formed of stainless steel.

The operation of the pump 10 is shown in FIGS. 1 and 2. Beginning from the biased rest position with the piston 30 in the up position, force applied to the actuator 80 causes the piston 30 to move downwardly. During this downward stroke, pressure increases in the chamber 50 until the upper valve 60 opens by the lifting up of the valve member 62 from the valve seat 64 by the pressurized contents of the chamber 50. Once upper valve 60 is opened, the contents of the chamber travel through the opening 34 and into the actuator 80 and are dispensed through the actuator nozzle 82 as shown in FIG. 2. If a stem 63 is provided on either the valve member 62 or the piston seat 42, the upper valve 62 is held open mechanically during the terminal portion of the downward stroke. A positive seal of the contents of the container 28 is obtained during the terminal portion of a downward stroke when the inner walls of the lower end 36 of piston 30 sealingly fit around the outer walls of the larger diameter segment 44 of the piston seat 42. If the piston 30 is held in this position, the container 28 and pump 10 may be transported with a reduced likelihood of leakage.

When the force on the actuator is released, the coil spring 54 causes the piston to move upwardly. During the upward stroke, pressure decreases in the chamber 50 to form a vacuum. During the initial portion of the upward stroke, the stem 63 continues to hold upper valve 60 open so as to draw material back from the actuator nozzle 82 into the pump 10. After this initial portion of the upward stroke, the upper valve 60 closes when the stem 63 moves out of contact with the piston seat 42, and the pressure in the chamber 50 continues to decrease until the lower valve 66 opens by the lifting up of the lower valve member 68 from the lower valve seat 70, as shown in FIG. 1, by the flow of the contents of the container, which flow is induced by the pressure differential between the container 28 and the chamber 50. As the piston 30 returns to its up position, the pressure differential between the chamber 50 and the container 28 is diminished and the lower valve 66 closes.

During each stroke, the vent 17 vents the container 28 to the compartment 96 defined by the closure 86, the body 12, and the piston 30, which compartment 96 is in turn vented to the atmosphere through the aperture 88 around the piston 30. The vent 17 allows the pressure in the container 28 to equilibrate with atmospheric pressure so that there is no build up of vacuum in the container 28 which would cause it to collapse and which would impede operation of the pump 10.

The pump 10 of the first embodiment of the invention provides a sealing closure of the container 28 when the piston 30 is sufficiently depressed so that the inner walls of the piston 30 slide onto the larger diameter segment 44 of the piston seat 42. This sealing closure can be maintained by the holding means described above to provide a sealed pump during transport of the container 28 and pump 10. Further, by providing a stem 63 which will hold the upper valve open during the initial portion of an upward stroke, the pump acts to draw material at the nozzle 82 back into the pump 10. In addition, by providing the described piston seat which extends into the body 12 and piston 30, the volume of the pump 10 which must be filled by each pump stroke is reduced, and also allows the creation of higher pressure differentials in the body 12 and piston 30 by each pump cycle, so that less liquid is required to prime the pump, and making it easier for the pump 10 to cause viscous liquids to be drawn into the chamber 50 when the pump 10 is being primed.

With reference to FIGS. 3–8, a second embodiment of a sealing pump 110 in accordance with the invention is shown. Pump 110 comprises a hollow body 112 having an upper opening 114 in its upper end 116 and a lower opening 118 in its lower end 120. Preferably the body 112 is cylindrical and has a flange 122 extending radially outwardly from its upper end 116. Preferably vent 117 is provided in the upper end 16 of the body 12. Preferably the lower end 120 of the body 112 is tapered in the vicinity of the lower opening 118. A hollow tube 124 extends from the lower end of the body 112, and a diptube 126 which extends down into the container 128 may be fitted onto tube 124. During operation of the pump 110, liquid is drawn up from container 128 through the diptube 126 into tube 124 and thence into pump 110.

A hollow piston 130 which is slidable reciprocally with sealing fit in body 112 is fitted into the upper end 116 of body 112. Piston 130 has an upper end 132 with an opening 134 therein, and a lower end 136 with an opening 138 therein. Preferably piston 130 is cylindrical. Preferably the lower end 136 has a larger diameter than the upper end 132. An annular chamber 140 may be provided in the lower end 136 of the piston 130.

Figure 5:
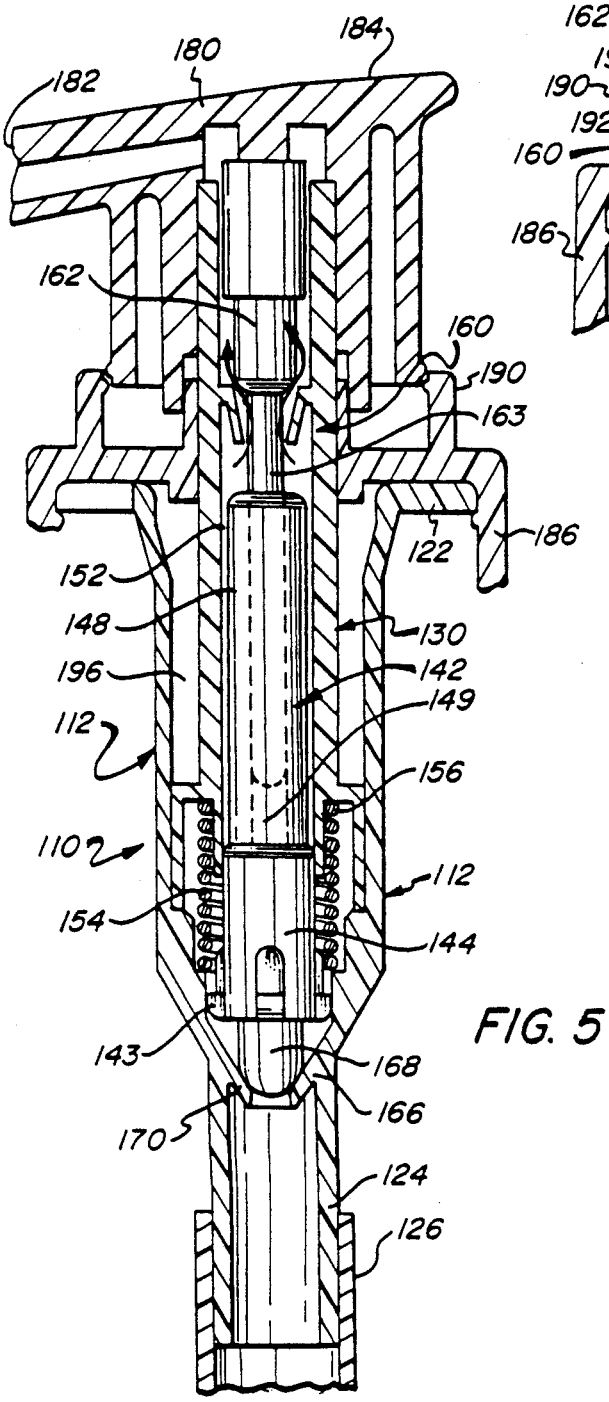
FIG. 5 is a cross-sectional view of the pump of FIG. 3, showing the piston in the down position at the end of a downward stroke.

A piston seat 142 sized to be received inside piston 130 is fitted inside the piston 130 and the body 112. Piston seat 142 is slidable reciprocally inside piston 130. As shown in FIG. 5, piston seat 142 has a larger diameter segment 144 at its lower end sized for sealing fit inside piston 130 when piston 130 is at the end of a downward stroke. A lower valve member 168 is located at the bottom of the smaller diameter segment 144. Preferably, the larger diameter segment has a flange 143 located between the lower valve member 168 and the segment 144. Flow passages 146 are provided in the larger diameter segment 144 so that liquid flowing up from the container 128 can enter the body 12.

Figure 3:
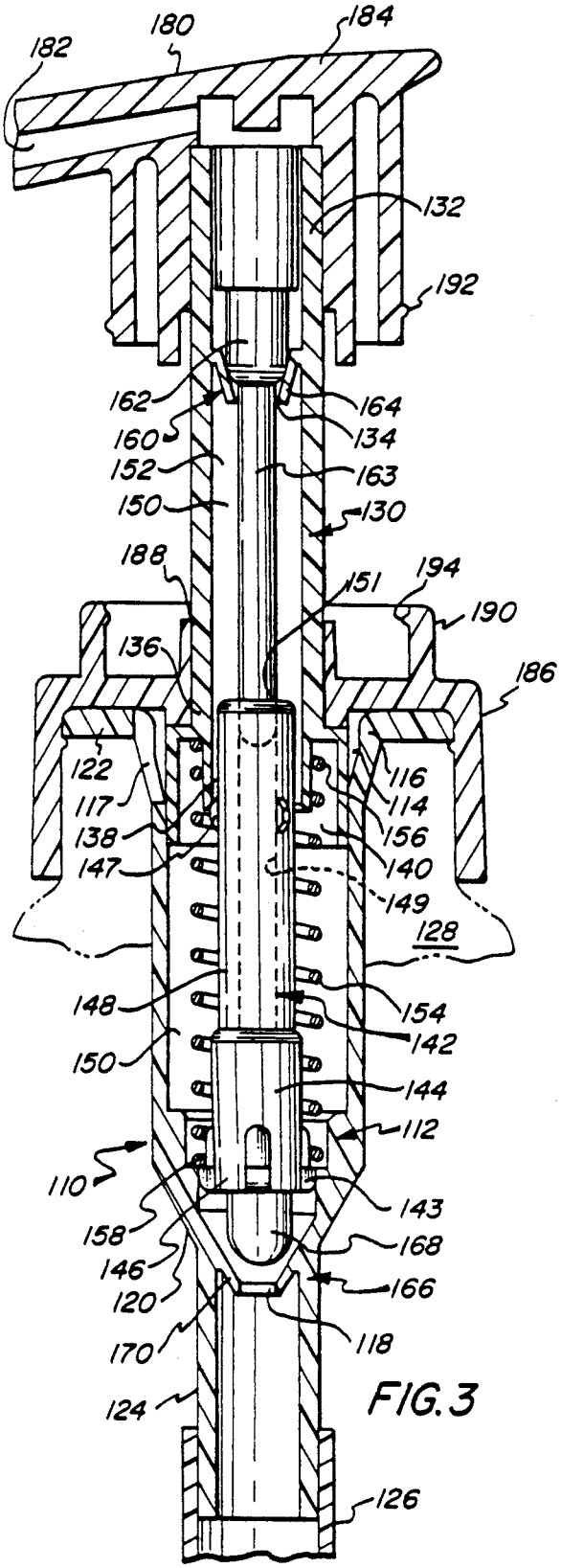
FIG. 3 is a cross-sectional view of a second embodiment of a pump of the present invention with its piston in an up position.
Figure 8:
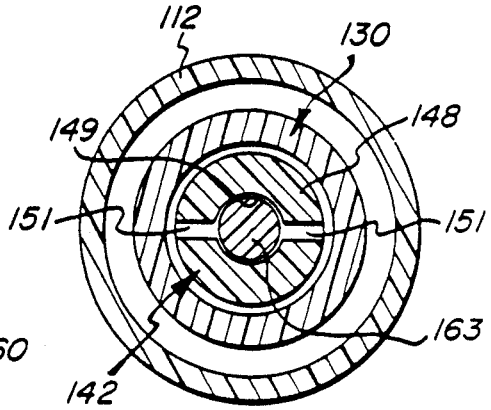
FIG. 8 is a cross-sectional view of the piston seat of the pump of FIG. 3.

Piston seat 142 has a smaller diameter segment 148 at its upper end sized to provide a space between the exterior of the smaller diameter segment 148 and the inner walls 152 of the piston 130. The smaller diameter segment 148 is a sleeve, i.e. it has a central bore 149 extending downwardly from its upper end to about the larger diameter segment 144. Preferably the sleeve is a split sleeve, as shown in FIG. 8, i.e., the bore 149 has channels 151 communicating with a chamber 150. If desired, ribs 147 may be provided, as shown in FIG. 3, on the outer walls of piston seat 142 to extend to about the inner diameter of the piston 130. Chamber 150 is defined by the inner walls of the piston 130, the inner walls of the body 112 and the outer walls of the piston seat 142.

Means for biasing piston 130 against a downward stroke and for biasing it with an upward stroke is provided, and preferably comprises a coil spring 154. The upper end 156 of the coil spring 154 fits into annular chamber 140 in the lower end of piston 130. The lower end 158 of coil spring 154 may be located to act as a stop for the piston seat 142 by acting on the flange 143.

An upper valve 160 is positioned in the upper end 132 of piston 130. Upper valve 160 is moveable to open the opening 134 in the upper end 132 of piston 130 during a downward stoke of piston 130 to dispense liquids from the chamber 150. Upper valve 160 is biased to be closed by the action of the biasing means. Upper valve 160 comprises an upper valve seat 164 formed in the upper end 132 of piston 130 and a valve member 162 having a stem 163 extending downwardly through the valve seat 164. Stem 163 is sized and adapted to be slidably fitted inside bore 149 of the smaller diameter segment 148 of piston seat 142. Stem 163 is sized to frictionally engage bore 149. Upper valve 160 is openable to dispense liquid from body 12 and piston 30 by a downward stroke of piston 30 because the upper valve seat 164 moves downwardly while the upper valve member 162 remains held stationary by the frictional engagement of stem 163 in bore 149.

A lower valve 166 is positioned in the lower end of body 112. Lower valve 166 is moveable to open the opening 118 in lower end 120 of body 112 during an upward stroke of piston 130, to permit liquid to enter chamber 150. Lower valve 166 is biased to open the opening 118 in the lower end 120 of body 112. Lower valve 166 comprises a lower valve seat 170 formed in the lower end 120 of body 112 and the lower valve member 168 formed on the bottom of piston seat 142. Lower valve 166 is closeable by a downward stroke of piston 130 because of the force applied to the upper valve member 162 by the lower end of a actuator 180 causes the piston seat 142 to move downwardly, thereby seating the lower valve member 168 in the lower valve seat 170. In alternative embodiments of the invention, the frictional engagement of the inner walls of the piston 130 with the ribs 147 on the piston seat 142 will similarly operate to close the lower valve 166. In addition, when the piston 130 is sufficiently depressed, the frictional engagement of the inner walls of the piston 130 with the outer walls of the larger diameter segment 144 of the piston seat 142 will cause the lower valve member 166 to close.

An actuator 180 may be seated on the upper end of piston 130. Actuator 180 has a nozzle 182 for dispensing liquid, and an upper surface 184 for finger actuation of the pump 110. Actuator 180 is adapted to press on the upper end of the upper valve member 162 after the upper valve 160 opens, and causes stem 163 to telescope inside bore 149 during the terminal portion of a downward stroke of the piston 130.

Pump 110 is secured to container 128 by a sealing container closure 186. The flange 122 of body 112 fits into container closure 186. Container closure 186 has a central aperture 188 through which extends the upper end 132 of piston 130. Piston 130 is retained in the body 112 by providing its lower end 136 with a larger diameter than its upper end 132 so that the lower end 136 cannot pass through the aperture 188 of the closure 186. Container closure 186 fits over the neck of the container 128, and may be held in place by screw threads formed on both, or by a snap fit combination.

Means for holding piston 130 in place at the bottom of a downward stroke is preferably provided. Preferably, the container closure 186 further comprises a collar 190 extending upwardly from closure 186, and the holding means comprises mating threads 192 and 194 formed on the outer surface of actuator 180 and on the inner surface of collar 190.

Preferably the various components of the pump 110 are formed of polymeric materials, preferably polypropylene or polyethylene. The coil spring is preferably formed of stainless steel.

Figure 4:
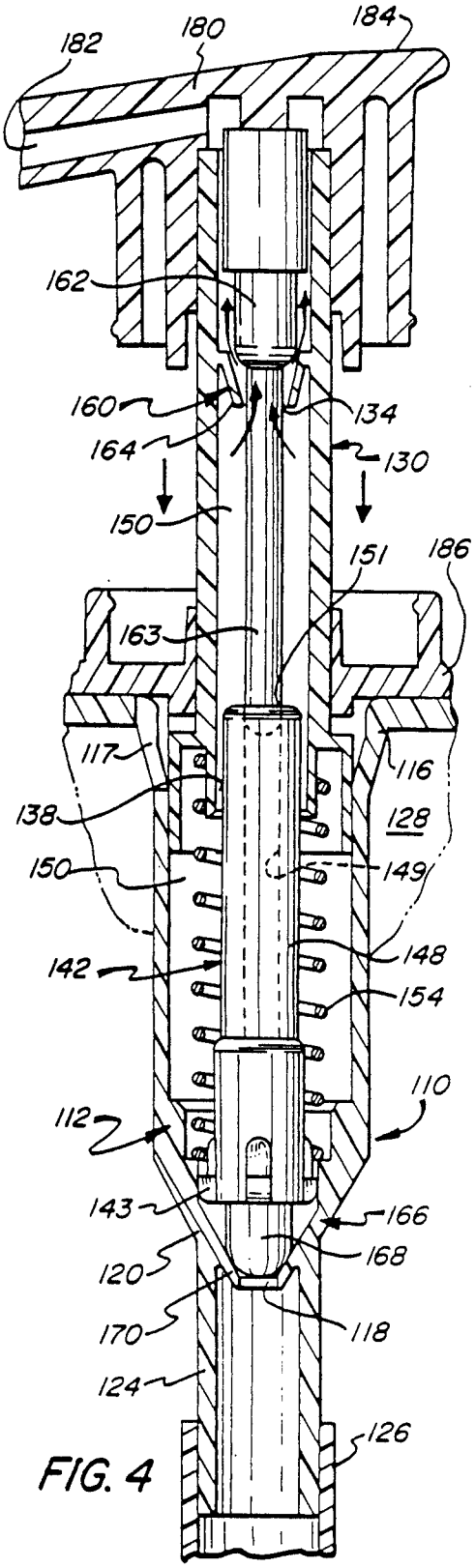
FIG. 4 is a cross-sectional view of the pump of FIG. 3, showing the initial portion of a downward stroke.

The operation of the pump 110 is shown in FIGS. 3–7. Beginning from the biased rest position shown in FIG. 3 with the piston 130 in the up position, the upper valve 166 is held closed by the frictional engagement of the stem 163 inside the bore 149 of the piston seat 142. Force applied to the actuator 180 causes the piston 130 to move downwardly, as shown in FIG. 4. During the downward stroke, the upper valve member member 162 remains stationary due to the frictional engagement of the stem 163 in the bore 149, while the valve seat 164 moves downwardly with the piston 130, so that the upper valve 160 is opened. As the actuator 180 and piston 130 continue through their downward stroke, as shown in FIGS. 4 and 5, the lower end of the actuator 180 contacts the upper end of upper valve member 162 and pushes on it. Once the actuator contacts the upper valve member 162, the frictional engagement of the stem 163 inside the bore 149 of piston seat 142 causes the piston seat 142 to move downwardly until the lower valve member 168 seats in lower valve seat 170, closing lower valve 166. If desired, a lip or other protrusion may be provided on the inner walls of piston 130 at its upper end 32 to contact and press on the upper valve member 162 to push it downwardly. The piston seat 142 may also be moved downwardly by the frictional engagement of the ribs 147 with the downwardly moving piston 130. At this point, the upper valve 160 is opened and the lower valve 166 is closed, allowing the pressure in chamber 150 to increase so that the contents of the chamber 150 travel through the opening 134 and into the actuator 180 and are dispensed through actuator nozzle 182 during the remainder of the downward stroke.

As the downward stroke of piston 130 continues, the stem 163 telescopes into the bore 149, by the action of the actuator 180 pushing on the upper valve member 162, during which time the upper valve 160 remains open.

Figure 6:
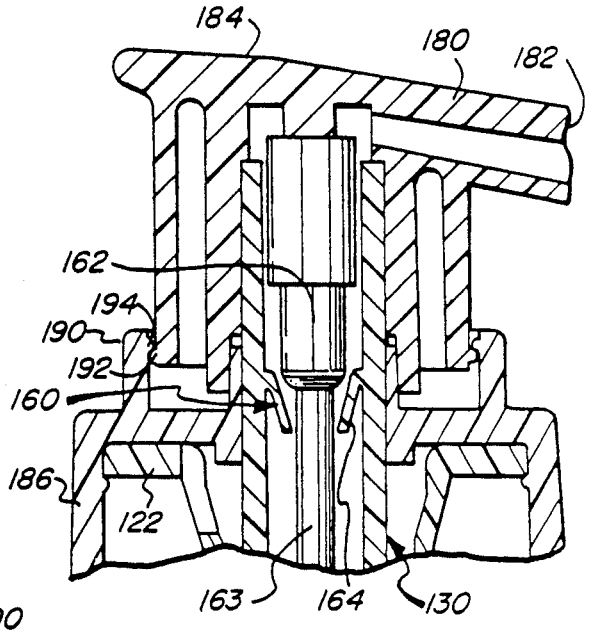
FIG. 6 is a cross-sectional view of the pump of FIG. 3 showing the piston holding means.

At the terminal portion of the downward stroke, shown in FIG. 5, the inner walls of the lower end 136 of the piston 130 are sealingly fitted around the outer walls of the larger diameter segment 144 of the piston seat 142. If the pump is provided with holding means, the piston may be held at the end of the downward stroke, as shown in FIG. 6, to prevent leakage of the contents of the container.

Figure 7:
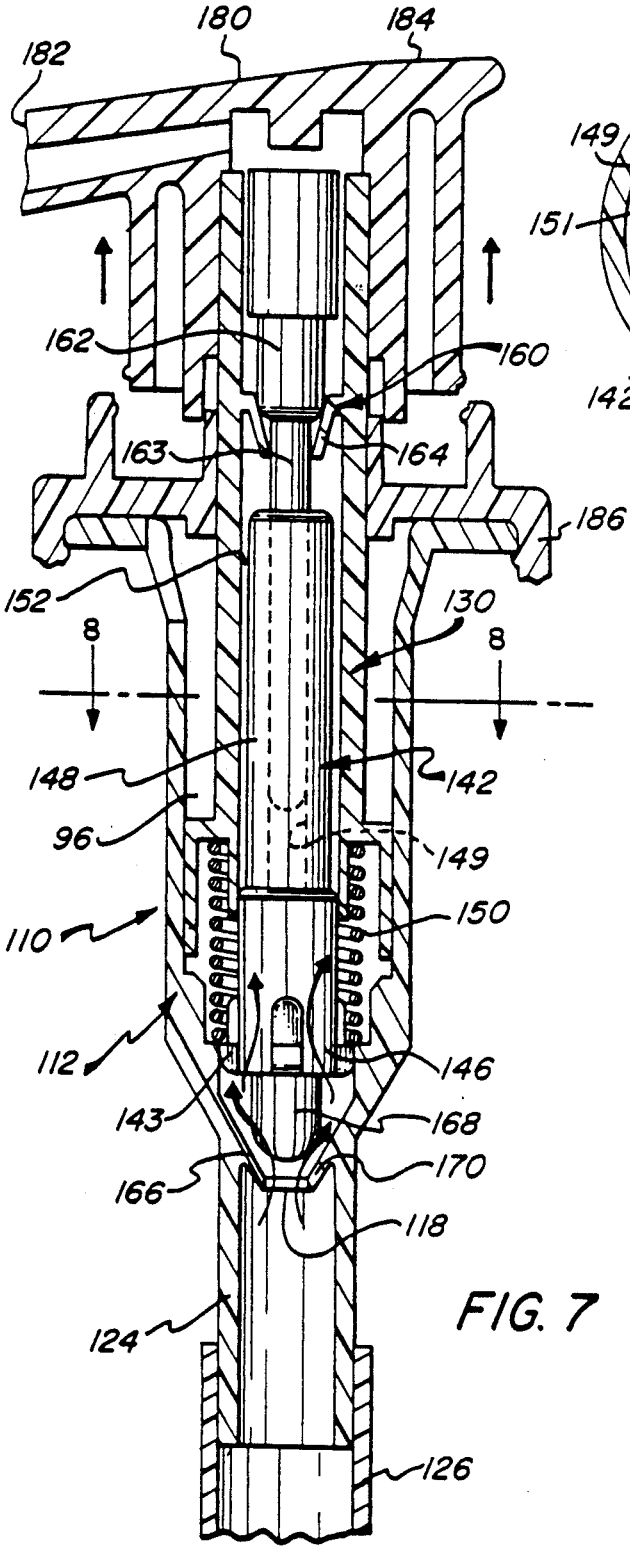
FIG. 7 is a cross-sectional view of the pump of FIG. 3 showing the middle portion of an upward stroke.

When the force on the actuator is released, the coil spring 154 causes the piston 130 to move upwardly. If the piston has not been depressed so far as to have sealingly fitted around the larger diameter segment 144, the lower valve 166 will remain closed during the initial portion of the upward stroke, and the upper valve 160 will remain open during the period of time while the upper valve seat 164 travels upwardly with the piston 130 until it contacts the upper valve member 162, which is held stationary by the frictional engagement of the stem 163 in bore 149. Thus any material at the actuator nozzle 182 is drawn back into the pump 110 as the volume of chamber 150 increases while the upper valve 160 remains open. As the piston continues in its upward stroke, the upper valve seat 164 contacts the upper valve member 162, closing valve 160, as shown in FIG. 7. The upper valve seat 164 pushes against the upper valve member 162 and causes the stem 163 to pull out of the bore 149. Due to the frictional engagement of these two parts, the piston seat 142 is pulled upwardly, which causes the lower valve member 168 formed thereon to be lifted up off of the lower valve seat 170, opening lower valve 166. The piston seat is limited in its travel and is stopped in its upward travel when its flange 143 reaches the lower end of coil spring 154, which acts as a stop. After valve 160 closes, the pressure in the chamber 150 decreases by the increase in the volume of the chamber 150, and liquid flows up from the container 128 through the lower valve 166 into the chamber 150.

If the piston 130 has been locked down in sealing frictional engagement with the larger diameter segment 144 of the piston seat 142, or if ribs 147 are provided on the piston seat 142, a slightly different series of events will occur. The release of force on the actuator 180 will cause the piston 130 to move upwardly. The piston 130, which is in frictional engagement with the larger diameter segment 144 of the piston seat 142 or the ribs 147 of the piston seat 142, carries the piston seat 142 upwardly and thereby opens the lower valve 166 by lifting the lower valve member 168 up off of the lower valve seat 170. During this time the upper valve 160 remains open, since upper valve member 162 moves upwardly with the piston seat 142, and thus the valve seat 164, which is moving upwardly with the piston 130, does not contact the upper valve member 162. When the piston seat reaches the end of its travel, the upper valve 166 will close when the upper piston seat 170 contacts the upper valve member 168, and liquid will be drawn into the chamber 150 as previously described.

During each stroke, the vent 117 vents the container 128 to the compartment 196 defined by the closure 186, the body 112, and the piston 130, which compartment 196 is in turn vented to the atmosphere through the aperture 188 around the piston 130. The vent 117 allows the pressure in the container 128 to equilibrate with atmospheric pressure so that there is no build up of vacuum in the container 128 which would cause it to collapse and which would impede operation of the pump 110.

The pump 110 of the second embodiment of the invention provides a sealing closure of the container 128 when the piston 130 is sufficiently depressed so that the inner walls of the piston 130 slide onto the larger diameter segment 144 of the piston seat 142. This sealing closure can be maintained by the holding means described above to provide a sealed pump and container during transport of the container 128 and pump 110.

In addition, the telescoping interaction between the upper and lower valve members holds the upper valve open during the initial portion of an upward stroke, so that the pump 110 can draw liquid at the nozzle 182 back into itself.

Further, by providing the described piston seat which extends into the body 112 and piston 130, the volume of the pump 110 which must be filled by each pump stroke is reduced, and also allows the creation of higher pressure differentials between the chamber 150 and the container 128 during each pump cycle, so that less liquid is required to prime the pump, and making it easier for the pump 110 to cause viscous liquids to be drawn into the chamber 150 when the pump 10 is being primed. Further, the action of the mechanically coupled valves is not impeded by viscous fluids.

The second embodiment of the invention also provides a pump mechanism which is useable in any position. Since the operation of the pump is based on mechanically activated valves, the pump is unaffected by gravity, and it will provide effective pumping in any position.

I claim:

1. A pump for dispensing liquids from a container, comprising:

a hollow body having upper and lower ends having openings therein;

a hollow piston slidable reciprocally with sealing fit in said body, said piston having upper and lower ends having openings therein;

a piston seat sized to be received inside said piston, said piston seat having a larger diameter segment at its lower end sized for sealing fit inside said piston when said piston is at the terminal portion of a downward stroke and the initial portion of an upward stroke of said piston, and a smaller diameter segment at its upper end sized to provide a space between said smaller diameter segment and the inner walls of said piston;

a chamber defined by said piston, body and piston seat;

means for biasing said piston against a downward stroke and for biasing said piston with an upward stroke;

an upper valve positioned in the upper end of said piston, said upper valve being moveable to open said opening in said upper end of said piston during a downward stroke of said piston to dispense liquids from said chamber; and a lower valve positioned in the lower end of said body, said lower valve being moveable to open said opening in said lower end of said body during an upward stroke of said piston to permit liquid to enter said chamber;

a dispensing nozzle located at the upper end of said piston, said upper valve being located between said dispensing nozzle and said chamber;

cooperating means on said upper valve member and the upper end of said piston seat to hold said upper valve open during an initial portion of an upward stroke of said piston, whereby a pressure gradient between said nozzle and said chamber is created to cause liquid being dispensed from said pump to be drawn towards said chamber from said nozzle.

2. A pump for dispensing liquids from a container in accordance with claim 1 further comprising an actuator seated on the upper end of said piston.

3. A pump for dispensing liquids from a container in accordance with claim 2, wherein:

said piston seat further comprises a lower valve member formed at its lower end and wherein said smaller diameter segment has a bore therein, and said piston seat is slidable reciprocally inside said piston;

said upper valve comprises an upper valve seat formed in the upper end of said piston, and a valve member having a stem extending downwardly and slidably fitting inside said bore of the smaller diameter segment of said piston seat, said stem being sized to frictionally engage said bore, said upper valve being openable to dispense liquid from said chamber by a downward stroke of said piston whereby said upper valve seat moves downwardly while said upper valve member is held stationary by the frictional engagement of said stem in said bore; and said lower valve comprises a valve seat formed in the lower end of said body, and said lower valve member formed on said piston seat, said lower valve being closeable by a downward stroke of said piston whereby said actuator contact with upper valve member which is frictionally engaged with said piston seat, causing said piston seat to move downwardly and seat said lower valve member against said lower valve seat.

4. A pump for dispensing liquids from a container in accordance with claim 2 further comprising a container closure fitted onto said upper end of said body having a central aperture therein through which extends said upper end of said piston.

5. A pump for dispensing liquids from a container in accordance with claim 4, further comprising means for holding said piston in place at the end of a downward stroke.

6. A pump for dispensing liquids from a container in accordance with claim 5, wherein said container closure further comprises a collar extending upwardly from said closure, and wherein said holding means comprises mating threads formed on the outer surface of said actuator and on the inner surface of said collar.

7. A pump for dispensing liquids from a container in accordance with claim 6, wherein the lower end of said piston has a larger diameter than the diameter of the upper end of said piston, and wherein said lower end of said piston further comprises an annular chamber for receiving said biasing means.

8. A pump for dispensing liquids from a container in accordance with claim 7, wherein said biasing means comprises a coil spring, the upper end of said coil spring being fitted into said annular chamber, the lower end of said coil spring holding the lower end of said piston seat adjacent to said opening in said lower end of said body and wherein said lower end of said body has a flow passage provided therein.

9. A pump for dispensing liquids from a container, comprising:

a hollow body having upper and lower ends having openings therein;

a hollow piston slidable reciprocally with sealing fit in said body, said piston having upper and lower ends having openings therein;

a piston seat sized to be received inside said piston, said piston seat having a larger diameter segment at its lower end sized for sealing fit inside said piston when said piston is at the terminal portion of a downward stroke and the initial portion of an upward stroke, said larger diameter segment being retained adjacent said opening in said lower end of said body and having a flow passage provided therein, and a smaller diameter segment at its upper end sized to provide a space between said smaller diameter segment and the inner walls of said piston;

a chamber defined by said piston, body, and piston seat;

means for biasing said piston against a downward stroke and for biasing said piston with an upward stroke;

an upper valve positioned in the upper end of said piston, said upper valve being adapted to close said opening in said upper end of said piston, said upper valve being moveable under liquid pressure to open said opening in said upper end of said piston during a downward stroke of said piston and dispense liquid from said chamber; and a lower valve positioned in the lower end of said body, said lower valve being adapted to close said opening in said lower end of said body, said lower valve being moveable under liquid pressure to open said opening in said lower end of said body during an upward stoke of said piston and permit liquid to enter said chamber;

a dispensing nozzle located at the upper end of said piston, said upper valve being located between said dispensing nozzle and said chamber;

cooperating means on said upper valve member and the upper end of said piston seat to hold said upper valve open during an initial portion of an upward stroke of said piston, whereby a pressure gradient between said nozzle and said chamber is created to cause liquid being dispensed from said pump to be drawn towards said chamber from said nozzle.

10. A pump for dispensing liquids from a container in accordance with claim 9, wherein said lower valve comprises a lower valve seat formed on the inner walls of said body, and a lower valve member.

11. A pump for dispensing liquids from a container in accordance with claim 9, wherein said upper valve comprises an upper valve seat formed on the inner walls of said piston, and an upper valve member.

12. A pump for dispensing liquids from a container in accordance with claim 11 wherein said cooperating means comprise a stem extending downwardly from said upper valve member through said upper valve seat and sized and adapted to contact the upper end of said piston seat and hold said upper valve open during a terminal portion of a downward stroke of said piston and during a initial portion of an upward stroke of said piston.

13. A pump for dispensing liquids from a container in accordance with claim 9 further comprising an actuator seated on the upper end of said piston.

14. A pump for dispensing liquids from a container in accordance with claim 13 further comprising a container closure fitted onto said upper end of said body having a central aperture therein through which extends said smaller diameter segment of said piston.

15. A pump for dispensing liquids from a container in accordance with claim 14, further comprising means for holding said piston in place at the end of a downward stroke.

16. A pump for dispensing liquids from a container in accordance with claim 15, wherein said container closure further comprises a collar extending upwardly from said closure, and wherein said holding means comprises mating threads formed on the outer surface of said actuator and on the inner surface of said collar.

17. A pump for dispensing liquids from a container in accordance with claim 16, wherein the lower end of said piston has a larger diameter than the diameter of the upper end of said piston, and wherein said lower end of said piston further comprises an annular chamber for receiving said biasing means.

18. A pump for dispensing liquids from a container in accordance with claim 17, wherein said biasing means comprises a coil spring, the upper end of said coil spring being fitted into said annular chamber, the lower end of said coil spring retaining said piston seat.

19. A pump for dispensing liquids from a container, comprising:

a hollow body having upper and lower ends having openings therein;

a hollow piston slidable reciprocally with sealing fit in said body, said piston having upper and lower ends having openings therein;

an actuator seated on the upper end of said piston;

a piston seat slidable reciprocally inside said piston, said piston seat having a larger diameter segment at its lower end sized for sealing fit inside said piston when said piston is at the terminal portion of a downward stroke and the initial portion of an upward stroke, said larger diameter segment having a lower valve member formed at its bottom, and a smaller diameter segment at its upper end sized to provide a space between said smaller diameter segment and the inner walls of said piston, and having a bore therein;

a chamber defined by said piston, body and piston seat;

means for biasing said piston against a downward stroke and for biasing said piston with an upward stroke;

an upper valve positioned in the upper end of said piston, said upper valve comprising an upper valve seat formed in the upper end of said piston, and an upper valve member having a stem extending downwardly and slidably fitting inside said bore of the smaller diameter segment of said piston seat, said stem being sized to frictionally engage said bore, said upper valve being openable to dispense liquid from said chamber by a downward stroke of said piston whereby said upper valve seat moves downwardly while said upper valve member remains held stationary by the frictional engagement of said stem in said bore; and a lower valve positioned in the lower end of said body, said lower valve comprising a valve seat formed in the lower end of said body, and said lower valve member formed on said piston seat, said lower valve being closeable by a downward stroke of said piston whereby said actuator contacts said upper valve member, causing said piston seat to move downwardly and seat said lower valve member against said lower valve seat.

20. A pump for dispensing liquids from a container in accordance with claim 19, further comprising ribs formed on said smaller diameter segment of said piston seat and extending outwardly therefrom, said ribs being sized for frictional engagement with said inner walls of said piston.

21. A pump for dispensing liquids from a container in accordance with claim 20, wherein said lower valve is closeable by a downward stroke of said piston by the frictional engagement of the inner walls of said piston with said ribs causing said piston seat to move downwardly and said lower valve member to seat against said lower valve seat.

22. A pump for dispensing liquids from a container in accordance with claim 19, wherein said actuator is adapted to press on the upper end of said upper valve member after opening of said upper valve during a downward stroke, whereby said stem is telescoped inside said bore of said piston seat during a downward stroke.

23. A pump for dispensing liquids from a container in accordance with claim 22 further comprising a container closure fitted onto said upper end of said body having a central aperture therein through which extends said smaller diameter segment of said piston with slidable sealing fit.

24. A pump for dispensing liquids from a container in accordance with claim 23, further comprising means for holding said piston in place at the end of a downward stroke.

25. A pump for dispensing liquids from a container in accordance with claim 24, wherein said container closure further comprises a collar extending upwardly from said closure, and wherein said holding means comprises mating threads formed on the outer surface of said actuator and on the inner surface of said collar.

26. A pump for dispensing liquids from a container in accordance with claim 25, wherein the lower end of said piston has a larger diameter than the diameter of the upper end of said piston, and wherein said lower end of said piston further comprises an annular chamber for receiving said biasing means.

27. A pump for dispensing liquids from a container in accordance with claim 26, wherein said biasing means comprises a coil spring, the upper end of said coil spring being fitted into said annular chamber, the lower end of said coil spring acting as a stop to limit the upward travel of said piston seat.

* * * * *